US007445374B2

(12) United States Patent
Forsey et al.

(10) Patent No.: US 7,445,374 B2
(45) Date of Patent: Nov. 4, 2008

(54) TWO-STATE CHRONOGRAPH WITH SWITCHING MEANS

(75) Inventors: Stephen Edward Methuen Forsey, Le Locle (CH); Robert Greubel, La Neuveville (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 395 days.

(21) Appl. No.: 10/528,300

(22) PCT Filed: Aug. 26, 2003

(86) PCT No.: PCT/IB03/03162

§ 371 (c)(1),
(2), (4) Date: Mar. 16, 2005

(87) PCT Pub. No.: WO2004/031872

PCT Pub. Date: Apr. 15, 2004

(65) Prior Publication Data

US 2005/0249044 A1 Nov. 10, 2005

(30) Foreign Application Priority Data

Oct. 7, 2002 (EP) ..... 02022505

(51) Int. Cl.
*G04F 7/00* (2006.01)

(52) U.S. Cl. ..... 368/101; 368/110

(58) Field of Classification Search ..... 368/110–114, 368/228, 101–107, 308, 319–321
See application file for complete search history.

(56) References Cited

U.S. PATENT DOCUMENTS

| | | | | | |
|---|---|---|---|---|---|
| 3,903,686 | A * | 9/1975 | Burki | 368/106 |
| 4,364,669 | A * | 12/1982 | Thoenig et al. | 368/111 |
| 4,389,122 | A * | 6/1983 | Dubois et al. | 368/110 |
| 4,588,305 | A * | 5/1986 | Piguet et al. | 368/185 |
| 4,748,603 | A * | 5/1988 | Ray et al. | 368/80 |
| 5,305,290 | A * | 4/1994 | Yoo | 368/76 |
| 6,570,823 | B1 * | 5/2003 | Gilomen et al. | 368/113 |
| 7,232,254 | B2 * | 6/2007 | Forsey et al. | 368/101 |
| 2001/0043512 | A1 * | 11/2001 | Igarashi et al. | 368/204 |

FOREIGN PATENT DOCUMENTS

| | | |
|---|---|---|
| CH | 1473 | 10/1889 |
| CH | 689 028 | 7/1998 |
| GB | 707 768 | 4/1954 |

* cited by examiner

*Primary Examiner*—Vit W. Miska
*Assistant Examiner*—Sean Kayes
(74) *Attorney, Agent, or Firm*—McGlew & Tuttle, P.C.

(57) ABSTRACT

The invention concerns a chronograph watch movement, comprising a chronograph mechanism, including: a chronograph gear-train comprising first (40) and second (38) wheels completing a revolution in sixty seconds and a revolution in a fraction of an hour respectively and arranged in the center of the movement, a control device (48) for starting and stopping the rotation of the chronograph gear-train, and a reset device (50). In said movement, the chronograph mechanism further comprises switching means designed such that, upon activation, they connect the second wheel (38) of the chronograph gear-train to a finishing mobile, so that the display means borne by the second wheel display the current time unit equivalent to that of the measured time.

16 Claims, 8 Drawing Sheets

30
43
29
391d
34d
36
40a
20
18
A
38c
32c
38a
38
38d
34b
52
38b
34
34c
393a
503
392a
392
42c
42a
391
34e
391e
32
32d
A
32b
32a
34a
391a
391c
391b
39
393b
393c
30
41
44
42b

TWO-STATE CHRONOGRAPH WITH SWITCHING MEANS

BACKGROUND OF THE INVENTION

The present invention concerns movements for chronograph watches. Such movements generally and conventionally comprise a frame, formed of a plate and bridges, and, carried by the frame:

an energy source, a time base powered by the energy source, a first, going train, driven in rotation in synchronism with the time base, and comprising a mobile for units of time selected from among the minutes and hours of the current time, and a chronograph mechanism, which includes:

a second, chronograph train, to be driven upon demand, in synchronism with the time base and comprising first and second wheels respectively completing one revolution in sixty seconds and one revolution in a time allowing the units of measured time, selected from among the hours and minutes, to be displayed and arranged coaxially with the first mobile, these wheels being arranged so that they can carry display means for displaying a measured time, for example hands, for indicating respectively the measured time seconds and the selected unit of the measured time, a control device for starting and stopping the rotation of the second train, and a device for resetting the display means.

Chronographs allow time intervals to be measured, by pressure on one or two push-buttons, mounted so as to slide on the watchcase, which control the chronograph mechanism. Successive applications of pressure assure the starting and stopping of the chronograph train, and consequently the start and end of the measurement.

The measured time is displayed by a chronograph second hand, carried by the first wheel of the chronograph train. Depending upon the type of chronograph, the first wheel also drives a wheel completing one revolution in thirty or sixty minutes and capable of carrying a measured time minute hand. This wheel is generally off-centre, such that the chronograph minute hand is smaller than the chronograph second hand.

Thus, in order to facilitate reading of the measured time minute, it is advantageous to have the chronograph minute hand at the centre of the movement. To prevent it being confused with the chronograph second hand, it has to be wider. As a result it tends to conceal the dial in the midday position when it is not operating. This can be inconvenient for reading the information given by the hands that are situated underneath, namely those for displaying the current time. It is an object of the present invention to overcome this drawback.

SUMMARY OF THE INVENTION

This object is achieved owing to the fact that the chronograph mechanism further includes switching means arranged so that they can occupy two states and in one of which they connect the second wheel of the chronograph train to the going train mobile, so that the display means carried by the second wheel display the unit of the current time equivalent to that of the measured time.

Advantageously the unit of time displayed by the mobile and the second wheel mentioned hereinbefore is the minute. Consequently, while the first member connects the chronograph train wheel for displaying the minutes and the current time minute mobile, the minute hand, carried by the chronograph train wheel, is in a position corresponding to the display of the current time minutes.

More specifically, the switching means comprise a hammer pivotably mounted on the current time minute mobile, a cam secured to the second chronograph train wheel and an elastic member holding the hammer abutting against the cam.

In order to guarantee that the switching means operate perfectly as defined hereinbefore, the chronograph mechanism further includes an isolation device, which comprises:

an isolation mobile provided with a first plate, of the same diameter as the first mobile, and a second plate arranged for cooperating with a pawl or click and carrying a pin for activating the hammer, a retaining member comprising a lever and a retaining wheel, mounted to be mobile in rotation on the lever and comprising first and second plates arranged to be able to mesh respectively with the first plate of the isolation mobile and the going train minute mobile, and connected to each other by a one-directional coupling mechanism, and isolation control members comprising:

an isolation lever, a pawl pivotably mounted on the lever and cooperating with the second plate of the isolation mobile, to move it with reference to the first plate, and with it the pin, which raises the hammer to interrupt the connection between the second wheel of the chronograph train and the going train minute mobile.

At the start of a time measurement, the chronograph second and minute hands must be at zero, to allow the user to know that his counter has been initialised. This could not happen when the measured time minute hand is superposed with the current time minute hand. Thus, in order to prevent any problem of comprehension as to operation, the chronograph mechanism further a locking device arranged for locking the control and reset devices while the switching means are connecting the second wheel of the chronograph train to the going train mobile.

In a first variant, the current time minute mobile is arranged to carry a current time minute hand and the second wheel of the chronograph train, a measured time minute hand. In this variant, when the switching means are in the state in which they connect the second wheel of the chronograph train to the going train mobile, the hands carried by the wheel and mobile are superposed.

In a second variant, only the second wheel of the chronograph train carries a hand, such that this hand displays the current time minutes while the locking device is locking the control device, and the measured time minutes in the opposite case. The information provided is thus reduced, but the watch is thinner, which improves its aesthetic appearance. It offers the advantage of providing a measured time minute display via a large hand, while only having three hands at the centre of the movement, namely those displaying the current time hour, the current time minute and the measured time minute as well as the measured time second.

Other advantages and features of the invention will appear from the following description, made with reference to the annexed drawings.

DESCRIPTION OF THE PREFERRED EMBODIMENT

In the following description, the position of certain components is sometimes defined with reference to a time. This position corresponds to the position on the dial occupied by the hour symbol displaying the given time.

Figure 1:
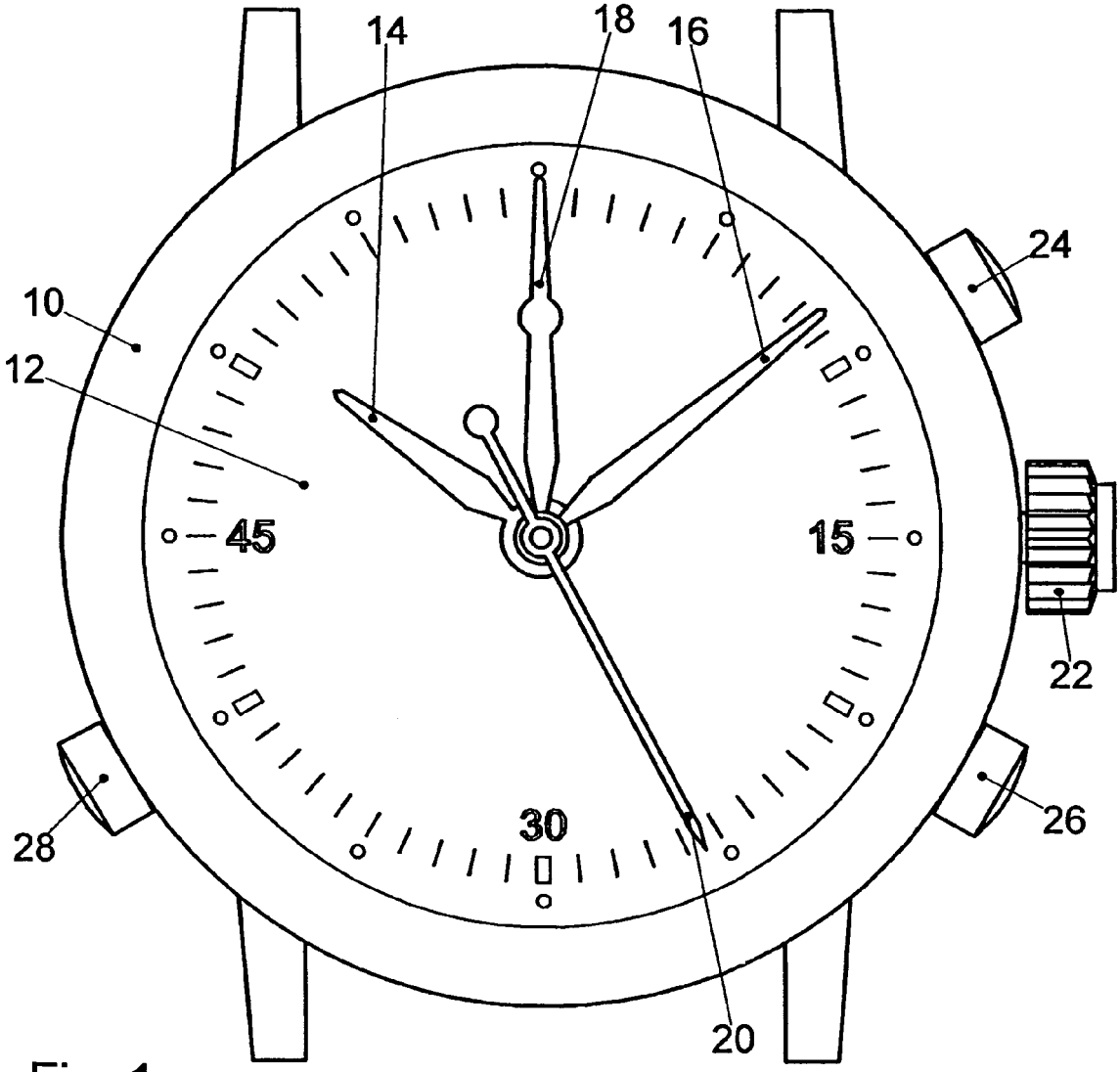
FIG. 1 shows a watch fitted with a movement according to the invention, in a state in which a measured time measurement is being carried out.

The watch shown in FIG. 1 is of the chronograph type. It comprises, in a conventional manner, a case 10 acting as housing for a movement, which carries a dial 12, a current time hour hand 14, a current time minute hand 16, measured time minute hand 18 and a measured time second hand 20.

The current time display is corrected by means of a time setting crown 22, connected to members of the movement by a time setting stem that is not visible in the drawing.

The timing related functions are performed by three push-buttons 24, 26 and 28 respectively disposed at two o'clock, four o'clock and eight o'clock. Push-button 24 controls the starting and stopping of a measured time measurement, whereas push-button 26 resets hands 18 and 20 when a measured time measurement has been interrupted. Finally, push-button 28 is for making the chronograph mechanism pass from a first state, in which it is locked, into a second state in which it is unlocked.

As will be explained hereinafter, the chronograph mechanism is arranged so that, when it is locked, current time minute hand 16 and measured time minute hand 18 are superposed and rotate together, whereas measured time second hand 20 is at midday. In this state, push-buttons 24 and 26 are inactive.

Figure 2:
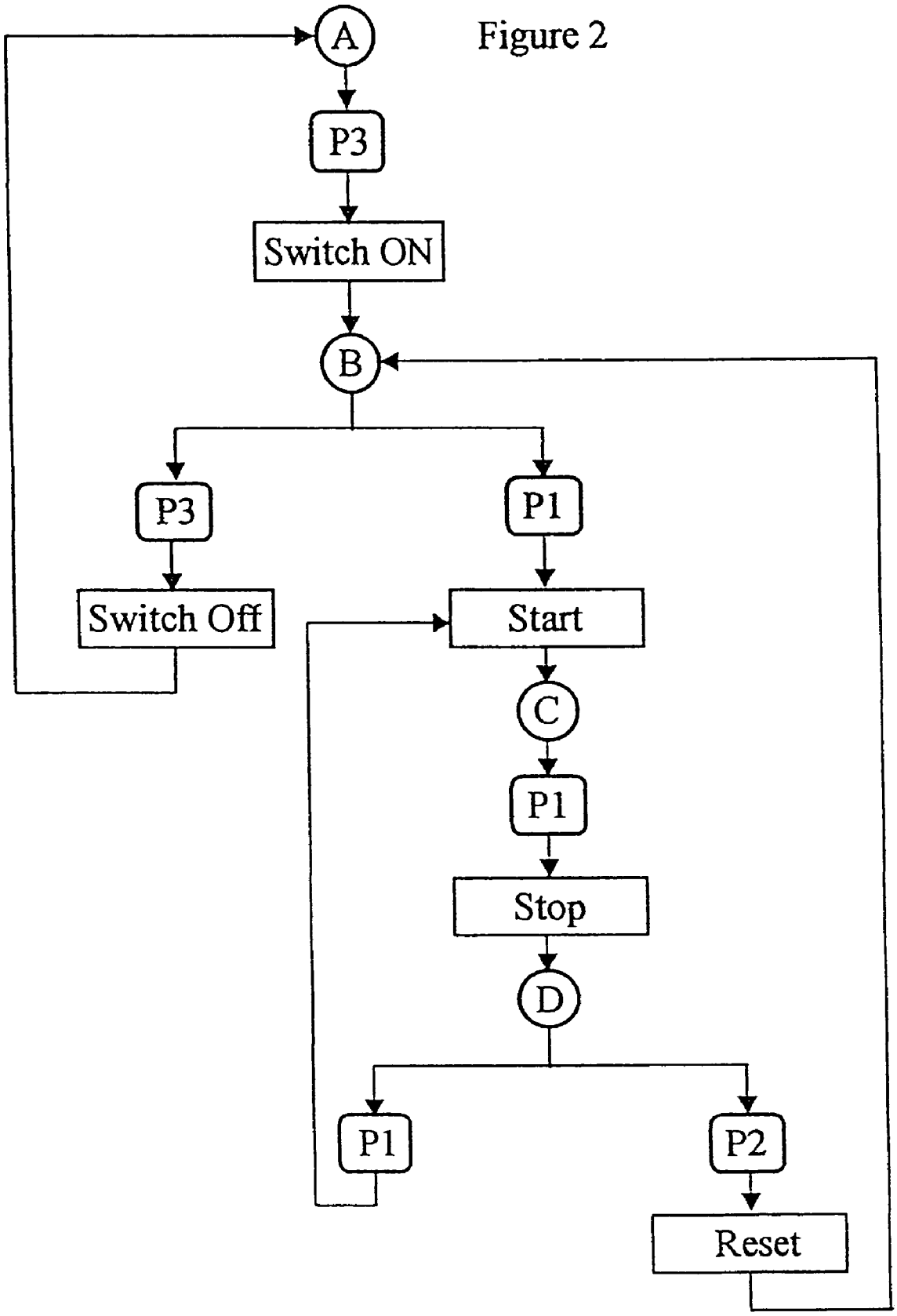
FIG. 2 is a logic operating diagram of the movement according to the invention.

FIG. 2 illustrates the effect of the various push-buttons depending upon the states of the chronograph mechanism, which are identified by a capital letter surrounded by a circle. An application of pressure onto push-buttons 24, 26 and 28, respectively corresponds to the indications P1, P2 and P3 of the Figure.

Figure 4A:
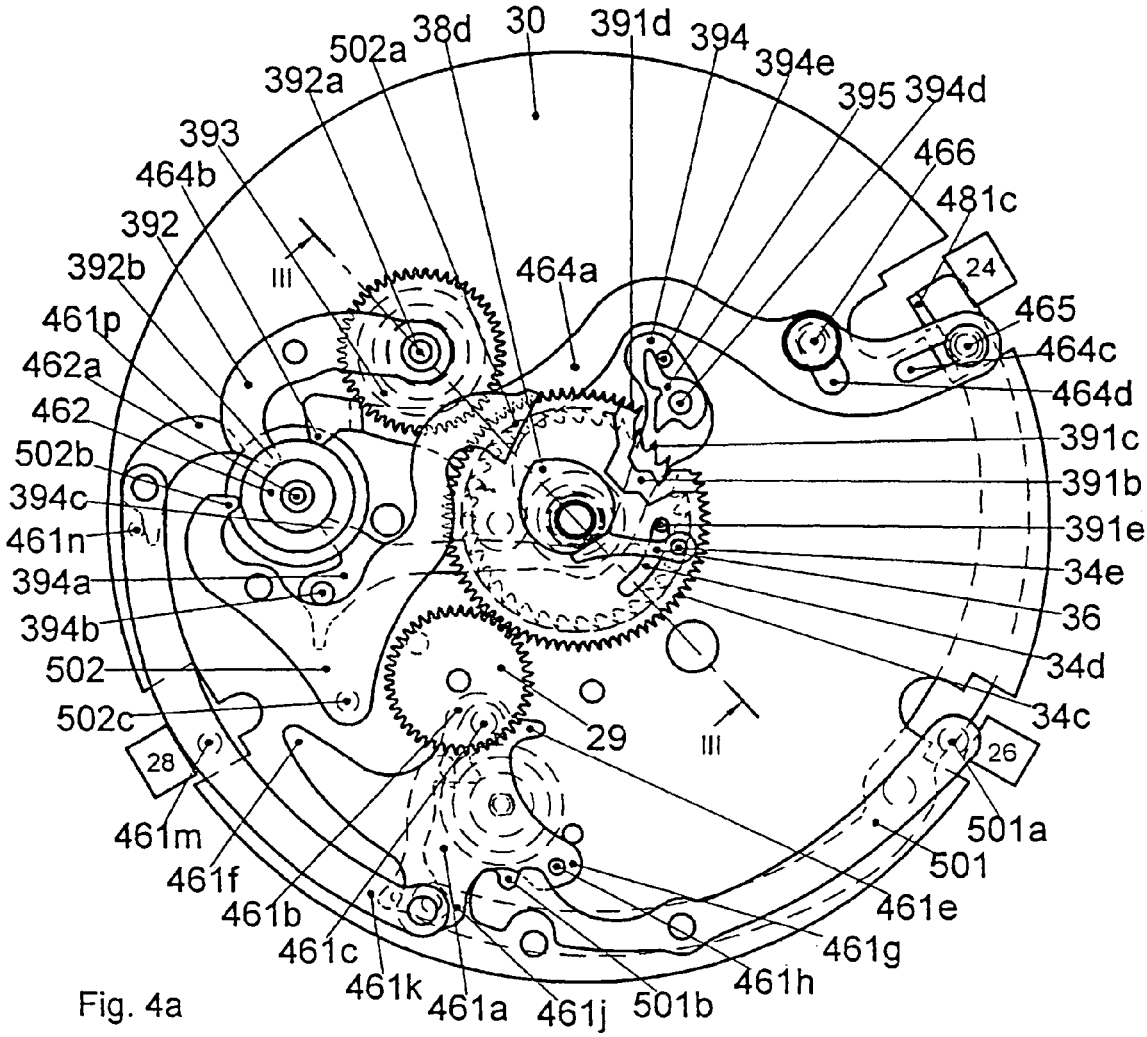
FIGS. 4*a* to 4*d* show the dial side of the movement, in various states corresponding to the steps defined in the diagram of FIG. 2.
Figure 4B:
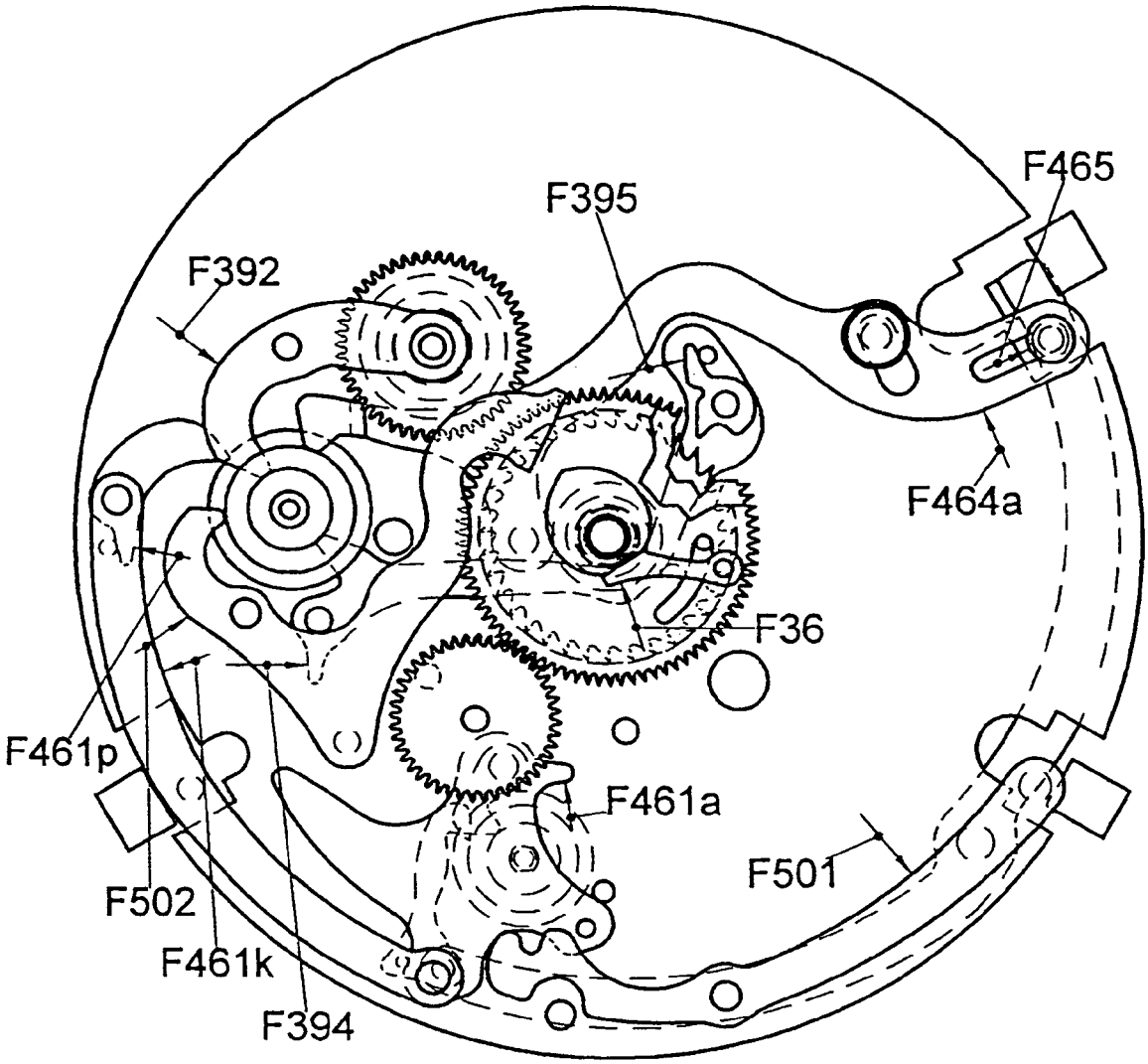

In the initial state, identified by A and corresponding to the situation illustrated by FIGS. 4*a* and 4*b*, the chronograph mechanism is locked. The chronograph second hand 20 is at midday and measured time minute hand 18 is superposed on current time minute hand 16, push-buttons 24 and 26 being inactive.

Figure 4C:
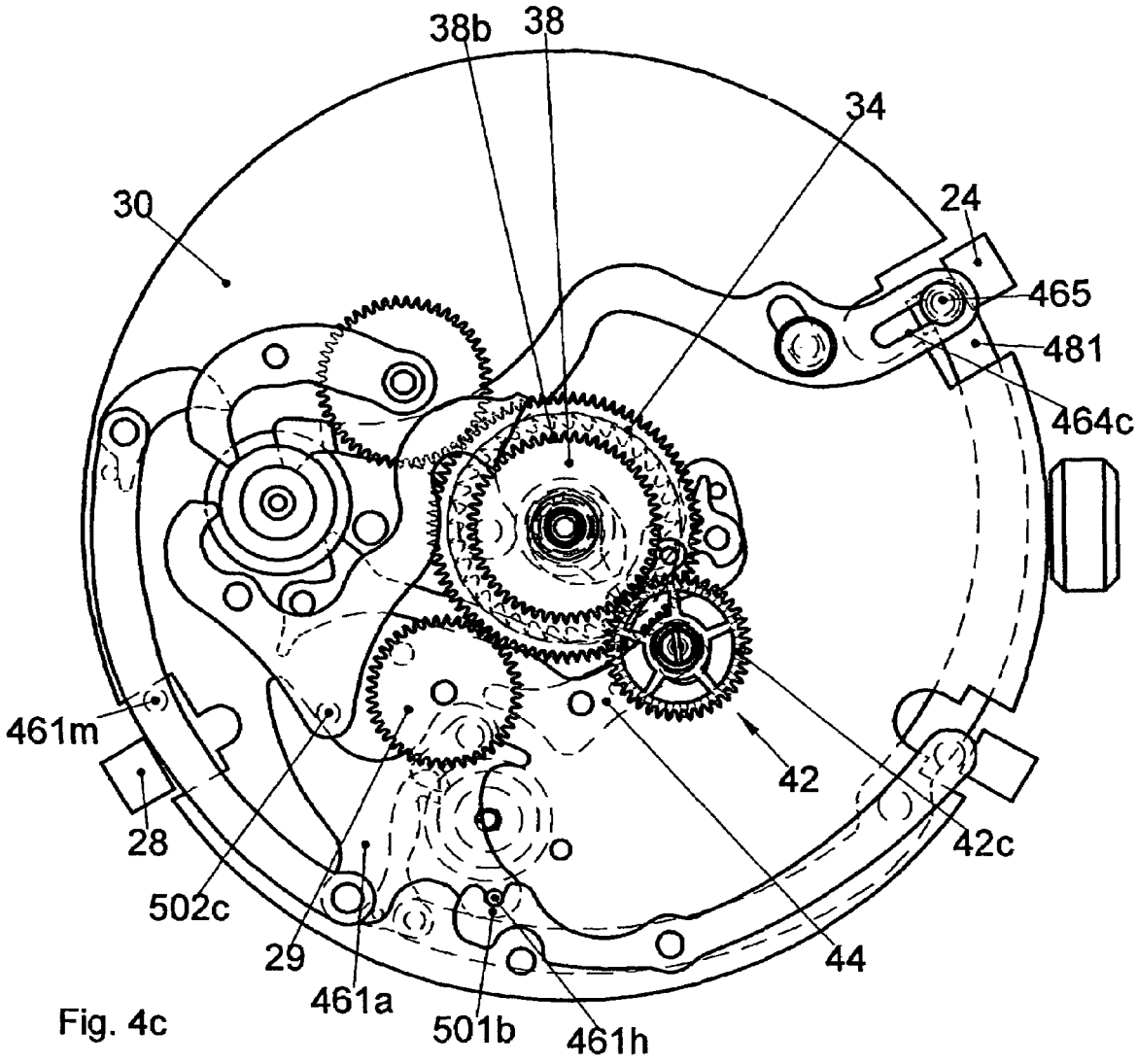

An application of pressure P3 causes the chronograph mechanism to unlock. As a result, measured time minute hand 18 leaves current time minute hand 16 to align at twelve o'clock, thus being superposed on the measured time second hand 20. This state, shown in FIG. 4*c*, is identified by the letter B.

In this state, push-buttons 24 (P1) and 28 (P3) are active. An application of pressure P1 has the effect of starting the counting of a measured time, the measured time second hand 20 starting to rotate and, more slowly, measured time minute hand 18. This state, shown in FIG. 4*d* and identified by the letter C, brings the display to the situation illustrated in FIG. 1.

In state B, an application of pressure P3 returns the chronograph mechanism to its initial state A.

In state C, only push-button 24 is active. An application of pressure P1 has the effect of stopping counting of the measured time. Hands 18 and 20 thus stop in the position corresponding to the measured time, which corresponds to state D, which differs from state B only in that the hands are not at zero.

Another application of pressure P1 then has the effect of restarting counting, the mechanism thus returning to state C, whereas an application of pressure P2 returns hands 18 and 20 to midday, which corresponds to state B.

In a variant, achieved by means of a movement like that described with reference to FIGS. 3 to 5, current time minute hand 16 is omitted. Consequently, the current time is read by means of current time hour hand 14 and minute hand 18 while the movement is in state A, whereas in the other states, minute hand 18 displays the measured time, the current time minutes having to be evaluated from the position of current time hour hand 14.

Figure 4D:
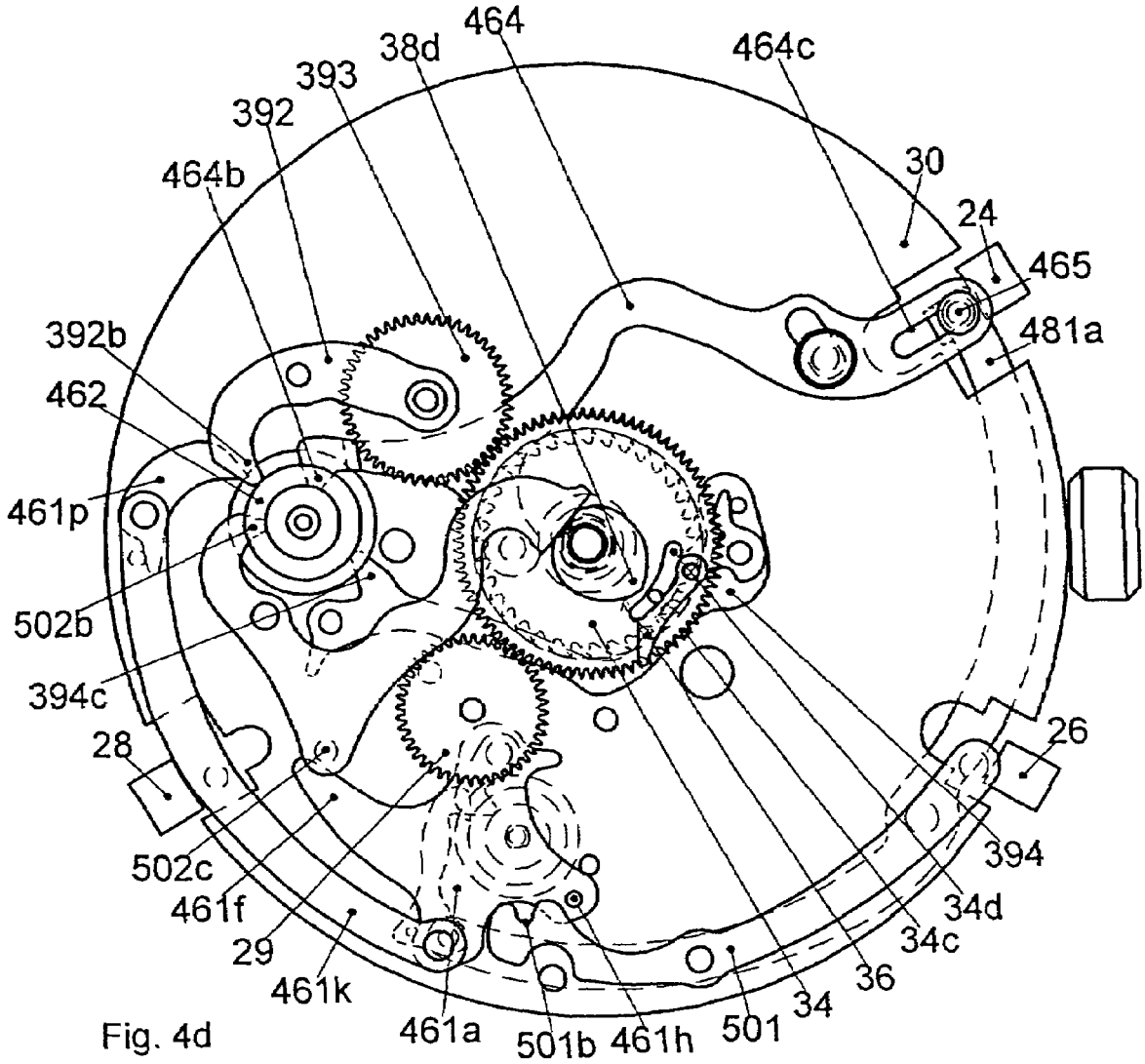
Figure 5:
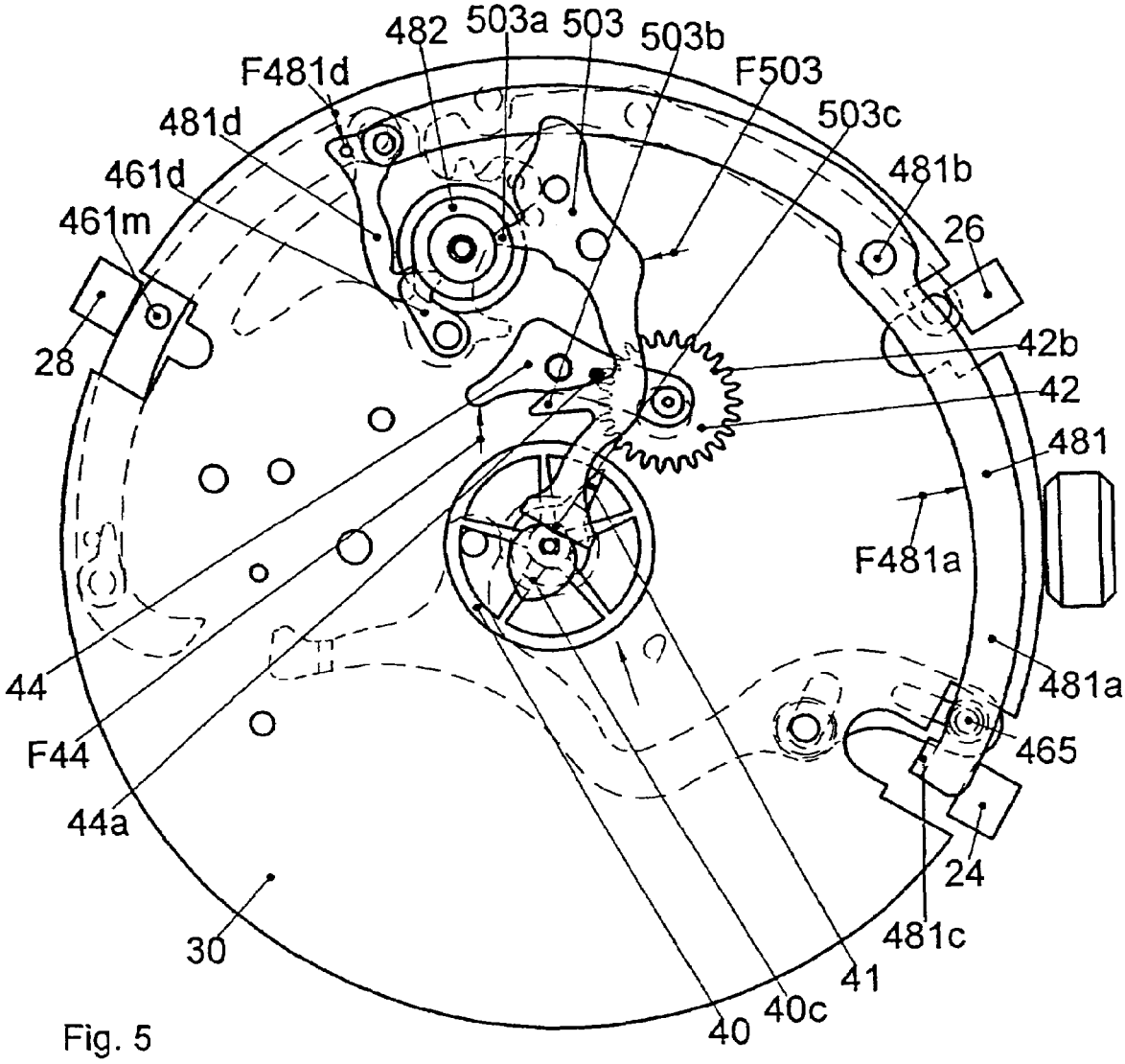
FIG. 5 illustrates the back cover side of the movement, when the chronograph function is locked.

In FIGS. 4 and 5 and in order to avoid overloading the drawings, the springs have only been shown schematically, by means of an arrow showing the force that they generate, associated with a reference Fi, "i" being equal to the reference of the part on which the spring is acting. They are essentially visible in FIG. 4*b*.

More precisely, FIGS. 4*a* and 4*b* show the mechanism in its rest position, corresponding to state A, and FIGS. 4*c* and 4*d* in positions corresponding respectively to states B and C of FIG. 2. In FIGS. 4*a* to 4*d*, which show the dial side of the movement, some parts have been removed or partially torn away from one or other of these Figures, in order for the subjacent parts to be seen more clearly.

The terms "wheel" or "mobile" are used to differentiate between the components of the chronograph train and going train respectively.

Figure 3:
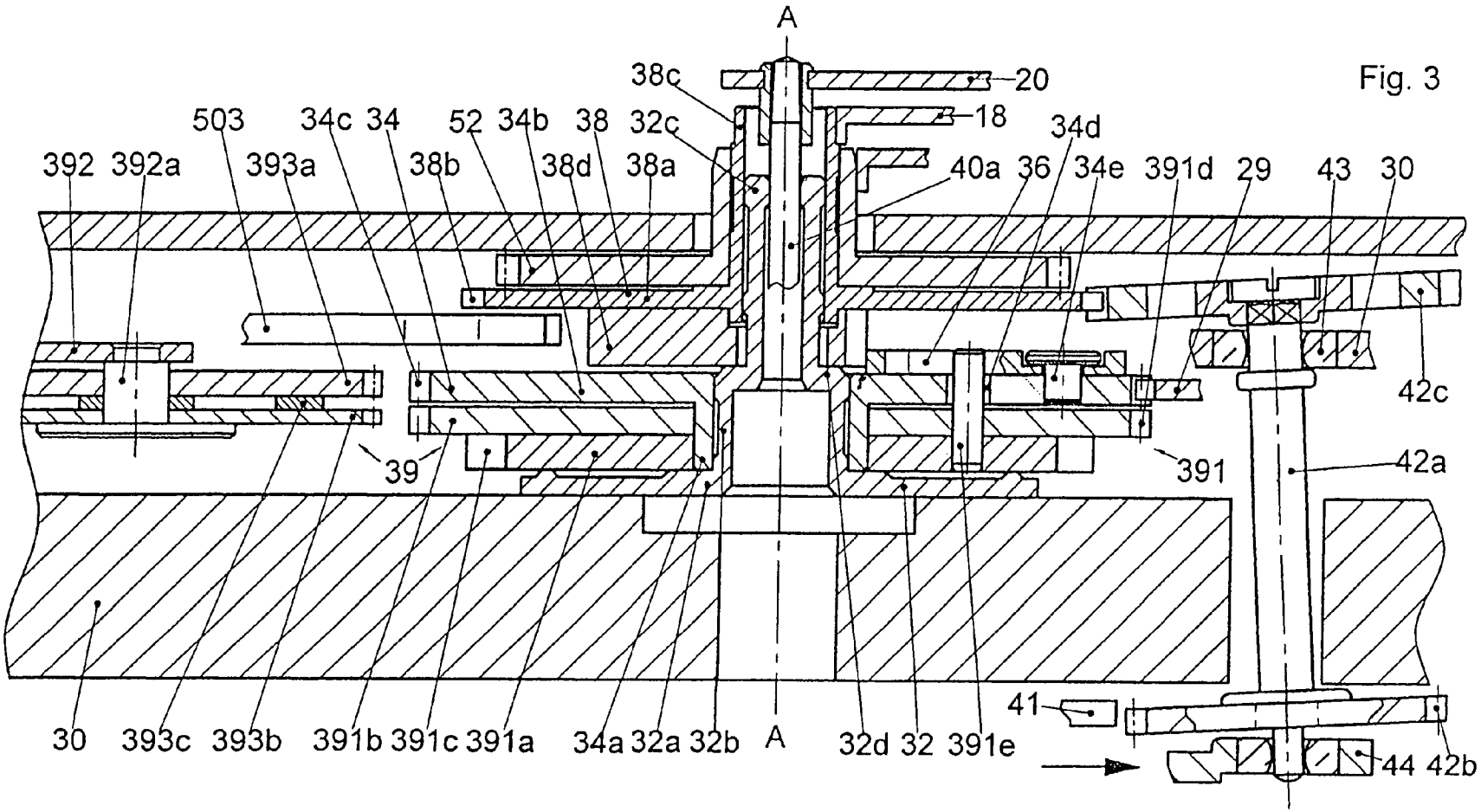
FIG. 3 is a cross-section of the movement according to the invention.

The movement of the invention comprises, in a conventional manner that is not visible in the drawing, an energy source such as a barrel, a time base such as a sprung balance, a going train of which only one mobile 29 is visible in FIGS. 3 and 4, and an escapement connecting the going train to the balance in order to maintain the latter, as well as time setting and chronograph mechanisms. These various components of the movement are disposed on a frame 30, formed of a plate and bridges, which assures the relative positioning of the various mobile parts of the movement.

FIG. 3 shows the central part of the movement, seen in cross-section along the line III-III of FIG. 4*a*, with an axis A-A corresponding to the axis about which the hands pivot. Frame 30 carries, rigidly secured to its dial side face, a tube 32 comprising a seat 32*a* secured to frame 30 and two cylindrical portions 32*b* and 32*c*, whose axis merges with axis A-A, and arranged one after the other, connected by a shoulder 32*d* and designed to act as a fixed arbour for the pivoting of the mobiles and wheels, as will be explained hereinafter.

A current time minute mobile 34 is pivotably mounted so as to pivot on tube 32. It is provided with a pipe 34*a* engaged on cylindrical portion 32*b* of tube 32 and a plate 34*b* including a toothing 34*c* at its periphery. Pipe 34*a*, plate 34*b* and toothing 34*c* are made in a single piece.

Mobile 34 meshes permanently, via its toothing 34*c*, with mobile 29 of the going train, in a gear ratio selected such that it completes one revolution per hour of current time.

Plate 34*b* is provided with:

- a cut out part 34*d* in the form of an annular portion covering an angle of approximately 50°, the function of which will be specified hereinafter,
- a stud 34*e*, to which a connecting hammer is secured, and a spring tending to return hammer 36 to the centre and schematically represented by arrow F36 (FIG. 4*b*).

A minute hand wheel 38 is pivotably mounted on cylindrical portion 32*c* of tube 32. This wheel 38 is only visible, in plan, in FIG. 4*c*. It comprises a plate 38*a* provided, at its periphery, with a toothing 38*b*, and a pipe 38*c* engaged on tube 32 and extending upwards sufficiently for its free end to be released and to allow minute hand 16 to be secured. The latter displays both the current time and the measured time, as will be explained hereinafter. Pipe 38*c* extends underneath plate 38*a*. A cam 38*d*, generally called a heart-piece, and more particularly visible in plan in FIGS. 4*a*, 4*b* and 4*d*, is secured by being driven in or welded thereto. Its lower face abuts against shoulder 32*d*. This cam 38*d* is arranged such that it can cooperate with hammer 36, as will be explained hereinafter.

The movement comprises an isolating device whose components' reference starts with 39 and which includes an isolation mobile 391 mounted on pipe 34*a*, a lever 392, a retaining wheel 393 pivotably mounted on lever 392, an isolation lever 394 and a pawl or click 395 mounted on lever 394 (FIG. 4*a*).

Mobile 391 comprises two superposed plates 391*a* and 391*b*, rigidly connected to each other and provided at their periphery with toothings respectively referenced 391*c* and 391*d*, and a pin 391*e* secured in plate 391*a*. This lower plate is provided with wolf teeth, clearly visible in FIG. 4*a*, whereas toothing 391*d*, of upper plate 391*b* comprises the same number of teeth and has the same profile and same diameter as toothing 34*c*. Pin 391*e* is engaged in cut out part 34*d* and extends as far as hammer 36.

Retaining lever 392 is mounted on frame 30, pivoting in its median part. It carries, at one of its ends, wheel 393 which can rotate on a stud 392*a* driven into lever 392, whereas the other end forms a nose 393*b* which, as will be explained hereinafter is for controlling the movement of lever 392. A spring F392 tends to apply nose 392*b* onto a support surface.

As shown schematically in FIG. 3, wheel 393 is formed of two plates 393*a* and 393*b*, connected to each other by a click 393*c* and respectively capable of being meshed with toothings 34*c* and 391*d*. Click 393*c* is arranged such that, when mobile 34 is rotating in the clockwise direction, the click is locked, such that plate 393*b* drives mobile 391 in rotation. If, conversely, it is the latter that is being rotated in the clockwise direction, only plate 393*b* is driven, click 393*c* performing its disconnecting function.

Lever 394 comprises (FIG. 4*a*):

- a body 394*a* pivotably mounted on frame 30, by the engagement of a hole 394*b* made at one of the ends of body 394*a* of the lever in an unreferenced stud, secured to frame 30,
- a nose 394*c*, located in proximity to hole 394*b* for controlling the movement of lever 394,
- a stud 394*d* driven into the body at the opposite end to that provided with hole 394*b*, on which pawl 395 pivots, and
- a pin 394*e*, forming a stop member and limiting the movement of pawl 395.

Lever 394 is positioned by nose 394*c* abutting against a support surface, via the action of a spring F394. A spring F395 tends to hold pawl 395 abutting against pin 394*e*.

Isolation mobile 391 can be moved by an angle of approximately 45° with respect to mobile 34, by the engagement of pawl 395 in toothing 391*c*. During this movement, pin 391*e*, moving freely in cut out part 34*d*, raises hammer 36 whose free end is brought back towards the exterior.

When the chronograph mechanism is locked, by means that will be explained hereinafter, hammer 36, positioned by spring F36, which tends to apply it against cam 38*d*, performs the function of connecting member between mobile 34 and wheel 38, which are thus secured to each other in rotation. This thus means that minute hand 18, carried by pipe 38*c* of wheel 38, displays the minutes of the current time.

In order to count the measured time, the movement shown in the drawing comprises a chronograph second hand 40, pivotably mounted in tube 32, visible in FIG. 5 and partially in FIG. 3, and a sliding gear 42 (FIGS. 3 and 4*c*). Wheel 40 comprises an arbour 40*a* pivotably mounted in tube 32 and in frame 30, a plate 40*b* driven onto arbour 40*a* and provided with a toothing, a cam 40*c*, also driven onto arbour 40*a*, and a drive finger 41.

The chronograph mechanism further includes a coupling mechanism, not visible in the drawing, provided with a wheel which, when the chronograph mechanism is in state C, kinematically connects wheel 40 to the going train, such that it is driven in rotation, at a rate of one revolution per minute. Such a coupling mechanism is well known to those skilled in the art.

Slide gear 42 comprises an arbour 42*a* (FIG. 3) rotatably mounted in a jewel 43, with an olive jewel-hole, driven onto a bridge of frame 30 and onto a lever 44, itself pivoting on frame 30 and which will be described in more detail hereinafter. It further comprises two wheels 42*b* and 42*c*, for cooperating respectively with finger 41 and wheel 38. Depending upon the position that lever 44 occupies, wheel 42*b* is either in the space swept by finger 41 or not. Moreover, wheel 42*c* is permanently meshed with toothing 38*b*. Lever 44 tends to move in the direction of the centre of the movement via the effect of a spring F44 (FIG. 5).

When the chronograph mechanism is in one of states B, C or D, hammer 36 is raised by pin 391*e*, such that it is no longer abutting against cam 38*d*. Mobile 34 and wheel 38 are thus no longer secured in rotation. Moreover, when the mechanism is in state C, arbour 42*a* is arranged parallel to axis A-A and its wheel 42*b* can be driven in rotation by finger 41, at a rate of one step for each revolution of wheel 40. In other words, slide gear 42 performs the function of a connecting member between measured time second wheel 40 and wheel 38, so that the latter displays the measured time minutes when the mechanism is in state C or D.

The connecting members formed by hammer 36, spring F36 and cam 38*d* on the one hand, and slide gear 42 on the other hand, perform together the function of switching means.

Since current time minute mobile 34 is permanently rotating, driven by the going train, isolation mobile 391 has to rotate with it, otherwise hammer 36 cannot be controlled. Therefore, retaining wheel 393 is made to mesh with toothings 34*c* of mobile 34 and 391*d* of isolation mobile 391, the two plates 393*a* and 393*b* being secured to each other in rotation by click 393*c*.

In order to perform the functions as defined with reference to FIG. 2, the chronograph mechanism shown in FIGS. 4 and 5 comprises, in addition to the gear trains and the isolation device described hereinbefore:

- a switch for enabling or disabling the timing function, and whose constituent parts are defined by references starting with 46,
- a control device, controlling the starting and stopping of a measurement, and whose constituent parts are defined by references starting with 48, and
- a reset device, for reinitialising the measured time counters, and whose constituent parts are defined by references starting with 50.

It should be noted that these devices interact and that some parts are arbitrarily defined as forming part of one device rather than another.

Switch 46 is controlled by push-button 28. It allows minute hand 16 to be returned to zero, and push-button 24 to be made active. It comprises, for this purpose (FIG. 4*a*):

a switching member 461, comprising:

a bird-shaped body 461*a*, with a head 461*b* provided with a hole 461*c* in which there is engaged a stem passing right through frame 30 and carrying a finger 461*d* visible in FIG. 5, a beak 461*e*, two wings 461*f* and 461*g*, wing 461*g* being provided with a pin 461*h*, and a tail 461*j*, the head being disposed on the centre side of the movement and tail 461*j* at the periphery, in proximity to 7 o'clock, a lever 461*k* pivotably mounted on tail 461*j* and extending over the periphery of the movement from 7 to 9 o'clock, provided with a pin 461*m* disposed so that it is or is not located on the path travelled by push-button 28, when it is activated depending upon the position occupied by lever 461*k*, and a stop member 461*n* arranged at its free end, a pawl 461*p* pivotably mounted on lever 461*k* and limited in its movement by stop member 461*n*, a switching cam, for example a column wheel 462, shown schematically, controlled in rotation by pawl 461*p*, rotating on frame 30 at 462*a*, and cooperating with noses 392*b* of lever 392 and 394*c* of lever 394, an interlocking lever 464, comprising a body of elongated shape 464*a*, pivotably mounted on frame 30 in its median part, and one of whose ends is provided with a nose 464*b* arranged for cooperating with the columns of wheel 462, whereas the other end comprises a first oblong hole 464*c* in which a stud 465 is mounted to slide, for cooperating with control device 48, and a second oblong hole 464*d*, in which a pin 466 with a head is housed, itself secured to frame 30, for positioning the lever in the plane of the movement.

The constituent parts of switch 46 are positioned by springs shown schematically in FIG. 4*b* and more particularly:

body 461*a* by spring F461*a*, lever 461*k* by spring F461*k* which tends to return it when pressure has been applied to push-button 28, pawl 461*p* by spring F461*p* which holds it pressed against pin 461*n*, body 464*a* by spring F464*a*, which tends to apply nose 464*b* against wheel 462, and stud 465 by spring F465, which tends to press it on the external side of oblong hole 464*c*.

Control device 48 is more particularly visible in FIG. 5. It comprises:

a control lever 481 comprising:

a body 481*a* disposed at the periphery of the movement from 2 to 7 o'clock, which pivots at 481*b* on frame 30 slightly below 4 o'clock, and which is provided, at one of its ends, with a bent portion 481*c* extending into the thickness of stud 465, and a pawl 481*d*, pivotably mounted on the other end of body 481*a*, whose function will be specified hereinafter, a cam 482, for example of the column wheel type, driven by pawl 481*d*, which controls the coupling mechanism of the chronograph, not shown in the drawing, and positions switching member 461 via its finger 461*d*.

The constituent parts of control device 48 are positioned by springs and more particularly:

body 481*a*, by spring F481*a* which tends to return it when pressure has been applied to push-button 24, and pawl 481*d*, by spring F481*d*, which applies it against cam 482.

Reset device 50 comprises:

a reset lever 501 (FIG. 4*a*) arranged and pivotably mounted at the periphery of frame 30 and extending from 4 o'clock to 6 o'clock, provided at its end in proximity to 4 o'clock with a pin 501*a* for cooperating with push-button 26, and at its other end with a groove 501*b* for cooperating with pin 461*h*, a hammer 502 for resetting the minutes arranged in proximity to column wheel 462 and extending as far as the central part of the movement to cooperate with cam 38*d* via a support surface 502*a* provided with:

a nose 502*b* which cooperates with column wheel 462, and a pin 502*c* for cooperating with wing 461*f*, and a hammer 503 for resetting the seconds (FIG. 5) pivotably mounted on the opposite face of frame 30 in proximity to cam 482, provided with:

a nose 503*a* cooperating with cam 482, a retaining finger 503*b* cooperating with lever 44 via a pin 44*a* comprised in the latter, and a support surface 503*c* for returning the second hand to zero by abutting against cam 40*c*.

The constituent parts of reset device 50 are positioned by springs and more particularly:

lever 501 by spring F501, which tends to return it after pressure has been applied on push-button 26, hammer 502 by spring F502, which tends to apply support surface 502*a* against cam 38*d*, and hammer 503 by spring F503, which tends to apply it against cam 40*c*.

The movement further comprises a current time hour mobile 52, pivotably mounted on pipe 38*c* of minute hand wheel 38. Mobile 52 carries current time hour hand 14. It is kinematically connected to mobile 34 by a motion work, which divides the movement by a factor of 12. This motion work has not been shown to avoid overloading the drawing.

When the chronograph mechanism is at rest, namely in state A defined with reference to FIG. 2, its constituent parts are in the position shown in FIGS. 4*a*, 4*b* and 5. More particularly, nose 392*b* of retaining lever 392 is between two columns of column wheel 462 via the effect of spring F392, such that retaining wheel 393 is not meshed with toothings 34*c* and 391*d*. Nose 394*c* of lever 394 is also between two columns via the effect of spring F394, so that pawl 395 is withdrawn from toothing 391*c*. Thus, via the action of spring F36, hammer 36 is abutting against cam 38*d*. Wheel 38 of the minute hand is rotating, consequently, in synchronism with current time minute mobile 34.

The interlocking lever 464 is abutting, via its nose 464*b* and via the effect of spring F464*a*, against a column of wheel 462, such that stud 465 is not inserted between push-button 24 and bent portion 481*c*, which disables push-button 24. Moreover, an action on push-button 26 causes lever 501 to pivot, but without it acting on any of the other parts.

An application of pressure on push-button 28 activates pin 461*m*, which drives with it lever 461*k*, which causes the chronograph mechanism to switch. More precisely, the tipping of lever 461*k* drives pawl 461*p*, which rotates column wheel 462 and generates the following movements, which occur practically simultaneously or in the following order:

nose 392*b* of retaining lever 392 is raised by a column, which causes wheel 393 to mesh with toothings 34*c* and 391*d*;

nose 394*c* of lever 394 is raised, such that pawl 395 meshes with toothing 391*c*, driving in rotation, clockwise, mobile 391 and the single plate 393*b*, plate 393*a*, meshed with mobile 34, being disconnected, because of click 393*c;* during the relative movement of mobile 391 with reference to mobile 34, pin 391*e* raises hammer 36, such that cam 38*d* of wheel 38 is no longer maintained in phase with mobile 34;

nose 502*b* of hammer 502 falls, via the effect of spring F502, between two columns of wheel 462, support surface 502*a* cooperating with cam 38*d* such that wheel 38, which carries hand 18, brings the latter to midday, and nose 464*b* of interlocking lever 464 falls between two columns of wheel 462 via the effect of spring F464*a*, bringing stud 465 between push-button 24 and bent portion 481*c*.

The mechanism is then in state B defined in FIG. 2 and shown in FIG. 4*c*. The connecting member formed by hammer 36 and cam 38*d* then no longer provides a connection between wheel 38 and mobile 34. Switch 46 thus plays the part of control member, and deactivates the connecting member.

In this state, push-buttons 24 and 28 are operational. If push-button 28 is pressed again, lever 461*k*, tips and drives pawl 461*p*. This causes column wheel 462 to rotate, which generates the following movements, which occur practically simultaneously or in the following order:

nose 392*b* of retaining lever 392 falls between two columns of wheel 462 via the effect of spring F392, wheel 393 thus being released from toothings 34*c* and 391*d;* nose 502*b* is raised by a column, such that hammer 502 releases cam 38*d;* nose 394*c* falls back between two columns and lever 394 returns to the position shown in FIG. 4*a* via the effect of spring F394;

via the effect of spring F36, hammer 36 tips and abuts against pin 391*e*, which causes isolation mobile 391 to rotate, then against cam 38*d* which drives wheel 38 until hand 18 again displays the minutes of the current time; and nose 464*b* of interlocking lever 464 is raised by a column of wheel 462 such that stud 465 leaves the space comprised between bent portion 481*c* and push-button 24.

The mechanism has thus returned to state A shown in FIG. 4*a*.

From state B, shown in FIG. 4*c*, it is also possible to actuate push-button 24, which has the effect of starting a measured time measurement. More specifically, push-button 24 abuts against stud 465, which slides into oblong hole 464*c* and, applied against bent portion 481*c*, causes body 481*a* of lever 481 to pivot. Its pawl 481*d*, more particularly visible in FIG. 5, causes cam 482 to rotate through one step. This movement of cam 482 generates the movements described hereinafter, which occur practically simultaneously or in the following order:

hammer 503, visible in FIG. 5, is raised via its nose 503*a*, such that support surface 503*c* is released from cam 40*c;* the chronograph coupling mechanism causes the coupling wheel to mesh both with the going train and the chronograph second wheel 40, so that the latter is driven in rotation and, with it, chronograph second hand 20;

retaining finger 503*b* releases pin 44*a* from lever 44, such that spring F44 causes lever 44 to pivot, wheel 42*b* being then positioned such that it is in the space swept by finger 41, which can then rotate slide gear 42 and, via the latter, minute hand wheel 38, at a rate of one step per minute, and finger 461*d* is raised by a column of cam 482, which causes body 461*a* (FIG. 4*b*) and lever 461*k* of switching member 461 to tip. Consequently, pin 461*m* is shifted with respect to push-button 28, thus disabling the latter. Moreover, wing 461*f* raises hammer 502 via its pin 502*c*, thus allowing minute hand wheel 38 to rotate.

Moreover, the pivoting of body 461*a* brings its pin 461*h* into groove 501*b* of reset lever 501. During this operation, the connecting member formed by slide gear 42, controlled by control device 48 via hammer 503, passes from the deactivated state to the activated state.

The mechanism is then in the position shown in FIG. 4*d*, which corresponds to state C of FIG. 2. In this state, only push-button 24 is active. In fact, pin 461*m* is shifted with respect to push-button 28, which disables the latter. Moreover, body 461*a*, whose position is defined by finger 461*d* abutting against a column of cam 482, remains in this position, even if groove 501*b* releases pin 461*h*. In other words, an application of pressure on push-button 26 has no effect.

An application of pressure on push-button 24 causes it to abut against stud 465 which slides into oblong hole 464*c* and, applied against bent portion 481*c*, causes lever 481 to pivot. Its pawl 481*d* (FIG. 5) causes cam 482 to rotate through another step. This movement of cam 482 generates the movements described hereinafter, which occur practically simultaneously, or in the following order:

the chronograph coupling mechanism is moved, such that chronograph second wheel 40 is no longer connected to the going train, which means that it stops;

finger 461*d* passes from abutting against a column of cam 482 to a position in which it is between two columns, without, however, body 461*a* and finger 461*d* pivoting, since body 461*a* is retained by pin 461*h* engaged in groove 501*b* of lever 501; and nose 502*a* of hammer 502 is between two columns of wheel 462, but it does not change position, because of pin 502*c* which is abutting against wing 461*f* of body 461*a*.

Hammer 503 is retained by similar means to those retaining hammer 502, but they have not been shown in order to avoid overloading the drawing. The chronograph mechanism is then in state D of the logic diagram of FIG. 2. This state, which is not shown in the drawing, allows action on push-buttons 24 and 26. An application of pressure on push-button 24 starts the time count, the mechanism returning to state C via another rotation of cam 482. Thus, the chronograph coupling mechanism is coupled again, whereas nose 503*a* of the hammer and finger 461*d* are abutting against a column of cam 482.

When the mechanism is in state D, an application of pressure on push-button 26 drives lever 501 which, by pivoting, releases pin 461*h*. Since finger 461*d* is between two columns of cam 482, nothing is holding it any longer, such that spring F461*a* returns switching member 461 to the position shown in FIG. 4*b*. Moreover, hammer 502 is no longer held by wing 461*f*, such that its spring F502 causes it to tip and abut against cam 38*d*, which has the effect of resetting minute hand 18 to zero.

A similar process is applied to hammer 503, such that cam 40*c* is also subjected to a force that returns measured time second hand 20 to midday. The chronograph mechanism is then again in state B defined hereinbefore, such that it is possible to press on push-button 28, to return the mechanism to state A, where push-buttons 24 and 26 are disabled and where minute hand 18 displays the minutes of the current time. It is also possible to press on push-button 24 in order to start a new measurement, the mechanism then being in state C.

The mechanism described with reference to FIGS. 3 to 5 comprises only one minute hand, which either displays the current time, or the measured time. It would also be possible, with a minor alteration, to have a hand 16 permanently displaying the current time minutes, whereas hand 18 displays the measured time minutes, as shown in FIG. 1. In order to do this, one need only provide mobile 34 with a pipe extending in the direction of the dial and which would insert the end thereof carrying hand 16 between pipe 38*c* of wheel 38 and tube 32.

Many other variants can also be envisaged, wherein the constituent parts of the members of the chronograph mechanism could take other forms and cooperate very differently, without thereby departing from the scope of the invention. Thus, column wheels 462 and 482 could advantageously be replaced by pivoting cams. It would also be possible to use an axial and/or friction coupling device, instead of mobile 42.

It is also entirely possible to envisage placing the current time hour hand off-centre and keeping only the measured time minute and second hands and the current time minute hand at the centre of the movement.

It is evident that the principle described is also applicable to the current time and measured time hour display, the hour hands either being central or off-centre.

In a variant that has not been described, it is also possible to omit switch 46, and consequently push-button 28, such that, when push-button 26 is activated, second hand 20 starts to rotate whereas minute hand 18 passes from the position where it is superposed on hand 16 to alignment at midday.

Thus, owing to the features described in the chronograph mechanism forming the subject of the present invention, it is possible to make a watch wherein the measured time minute and/or hour hand does not overload the display during the time when the mechanism is not in operation. Moreover, the mechanism enables the start, stop and reset functions to be locked, when there is no measurement being carried out.

What is claimed is:

1. A chronograph watch movement, including a frame and, carried by the frame, the chronograph watch movement comprising:

an energy source, a time base powered by the energy source, a first going train element driven in rotation in synchronism with said time base, said first going train element including a mobile element associated with units of time selected from among the minutes and hours of the current time; and a chronograph mechanism including:

a second chronograph train element for driving in synchronism with the time base, said second chronograph train element including first and second wheels respectively completing one revolution in sixty seconds and one revolution in a time allowing the measured units of time, selected from between the hours and minutes, to be displayed, said first wheel and said second wheel being arranged coaxially with said mobile element, said wheels being arranged such that said wheels carry display means for displaying a measured time;

a control device for starting and stopping said wheels of said second train;

a device for resetting the display means; and a switching means for switching between a connected state and a disconnected state such that said second wheel of said chronograph train is connected to said mobile element of said going train element when said switching means is in a connected state, whereby said display means connected to said second wheel displays the unit of current time equivalent to the measured time, said unit of current time and said unit of measured time being a minute, said switching means including a hammer pivotably mounted on the mobile element, a cam secured to the second wheel and an elastic member holding the hammer abutting against the cam.

2. A movement according to claim 1, further comprising an isolation device including:

an isolation mobile element including a first plate of the same diameter as the first mobile, and a second plate arranged for cooperating with a pawl and provided with a pin for activating the hammer;

a retaining member comprising a lever and a retaining wheel, mounted to be mobile in rotation on the lever and comprising first and second plates arranged to be able to mesh respectively with the first plate of the isolation mobile and the minute mobile of the first train element, and connected to each other by a one-directional coupling mechanism, and isolation control members comprising:

an isolation lever, a pawl pivotably mounted on the lever and cooperating with the second plate of the isolation mobile element, to move it with reference to the first plate, and with it said pin, which raises the hammer to interrupt the connection between the second wheel of the second train and the minute mobile of the going train.

3. A movement according to claim 1, wherein the chronograph mechanism further includes a locking device arranged for locking the control device while the switching means are connecting the second wheel of the second train element to said mobile element.

4. A movement according to claim 3, wherein said mobile element is connected to a current time minute hand and the second wheel a measured time minute hand, such that, while the locking device is locking the control device, the switching means position the second wheel with reference to the first mobile such that the two hands are superposed.

5. A movement according to claim 3, wherein only the second wheel carries a minute hand, such that said minute hand displays the current time minutes while the locking device is locking the control device, and the measured time minutes in the opposite case.

6. A chronograph watch movement, including a frame, the chronograph watch movement comprising:

an energy source;

a time base powered by the energy source;

a current time measuring hand a first drive train rotating in synchronization with said time base, said first drive train element including a first gear connected to said current measuring time hand;

a chronograph mechanism including:

a first display means;

a second display means;

a second chronograph drive train actuated in synchronism with said time base, said second chronograph drive train including a first chronograph gear and a second chronograph gear, said first chronograph gear completing one revolution in sixty seconds, said second chronograph gear completing one revolution in sixty minutes, said first chronograph gear and said second chronograph gear being arranged coaxially with said first gear of said first drive train, said first chronograph gear being connected to said first display means, said second chronograph gear being connected to said second display means;

a control means for controlling said first chronograph gear and said second chronograph gear;

a resetting means for resetting said first display means and said second display means; and a switching means for switching between a connected state and a disconnected state such that said second chronograph gear of said chronograph drive train is connected to said first gear of said first drive train when said switching means is in said connected state, said second display means being superimposed with said current measuring time hand when said second chronograph gear is connected to said first gear, said unit of current time and said unit of measured time being a minute, said switching means including a hammer pivotably mounted on the first gear, a cam secured to the second wheel and an elastic member holding the hammer abutting against the cam.

7. A movement according to claim 6, further comprising an isolation device including:

an isolation gear including a first plate of the same diameter as the first gear, and a second plate arranged for cooperating with a pawl and provided with a pin for activating the hammer;

a retaining member comprising a lever and a retaining wheel mounted for rotation on the lever, said retaining member including first and second plates arranged such that said first and second plates mesh respectively with the first plate of the isolation gear and the minute gear of the first train drive, and connected to each other by a one-directional coupling mechanism, and isolation control members comprising:

an isolation lever, a pawl pivotably mounted on the lever and cooperating with the second plate of the isolation gear to move said pawl with respect to the first plate and said pin, said pin raising the hammer to interrupt the connection between the second wheel of the second drive train and the minute gear of the first drive train.

8. A movement according to claim 6, wherein the chronograph mechanism further comprises a locking device for locking the control device when the switching means connects the second chronograph gear of the second drive train to said first gear.

9. A movement according to claim 8, wherein said second display means is a measured time minute hand, said locking device locking said control means, said switching means positioning the second chronograph gear with respect to said first gear such that the two hands are superimposed when said locking device locks said control means.

10. A movement according to claim 8, wherein only the second chronograph gear is connected to a minute hand, said minute hand displaying the current time minutes while the locking device locks said control device, said minute hand displaying the measured time minutes when said locking device unlocks said control device.

11. A chronograph watch movement, including a frame, the chronograph watch movement comprising:

an energy source;

a time base powered by the energy source;

a current time measuring hand;

a first drive train rotating in synchronization with said time base, said first drive train element including a first gear connected to said current measuring time hand;

a chronograph mechanism including:

a measuring time hand;

a second hand;

a second chronograph drive train for driving in synchronism with said time base, said second chronograph drive train including a first chronograph gear connected to said second hand and a second chronograph gear connected to said measuring time hand, said first chronograph gear completing one revolution in sixty seconds, said second chronograph gear completing one revolution in sixty minutes, said first chronograph gear and said second chronograph gear being arranged coaxially with said first gear of said first drive train;

a control means for controlling said first chronograph gear and said second chronograph gear;

a resetting means for resetting said measuring time minute hand and said second hand;

a switching means for connecting said second chronograph gear of said chronograph drive train to said first gear of said first drive train, said measuring time hand being superimposed with said current measuring time hand and rotating therewith when said second chronograph gear is connected to said first gear, said current time and said measured time being measured in minutes, said switching means including a hammer pivotably mounted on the first gear, a cam secured to the second wheel and an elastic member holding the hammer abutting against the cam.

12. A movement according to claim 11, further comprising an isolation device including:

an isolation gear including a first plate of the same diameter as the first gear, and a second plate arranged for cooperating with a pawl and provided with a pin for activating the hammer;

a retaining member comprising a lever and a retaining wheel mounted for rotation on the lever, said retaining member including first and second plates arranged such that said first and second plates mesh respectively with the first plate of the isolation gear and the minute gear of the first train drive, and connected to each other by a one-directional coupling mechanism, and isolation control members comprising:

an isolation lever, a pawl pivotably mounted on the lever and cooperating with the second plate of the isolation gear to move said pawl with respect to the first plate and said pin, said pin raising the hammer to interrupt the connection between the second wheel of the second drive train and the minute gear of the first drive train.

13. A movement according to claim 11, wherein said current time minute hand being superimposed with said measuring time hand when said chronograph mechanism is in said locked state.

14. A movement according to 11, wherein said chronograph mechanism further comprises a locking means for locking and unlocking said control means such that said chronograph mechanism is in a locked state or an unlocked state, said chronograph mechanism being in said locked state when said switching means connects said second chronograph gear of said second drive train to said first gear, wherein a position of said measuring time hand defines a measured time when said control means is in said unlocked state, said measuring time hand displaying a current time when said control means is in a locked state, said measuring time hand displaying said measured time when said control means is in said unlocked state.

15. A chronograph watch movement, including a frame, the chronograph watch movement comprising:

an energy source, a time base powered by the energy source, a first going train element driven in rotation in synchronism with said time base, said first going train element including a mobile element associated with units of time selected from among the minutes and hours of the current time; and a chronograph mechanism including:

a second chronograph train element for driving in synchronism with the time base, said second chronograph train element including first and second wheels respectively completing one revolution in sixty seconds and one revolution in a time allowing the measured units of time, selected from between the hours and minutes, to be displayed, said first wheel and said second wheel being arranged coaxially with said mobile element, said wheels being arranged such that said wheels carry display means for displaying a measured time;

a control device for starting and stopping said wheels of said second train;

a device for resetting the display means; and a switching means for switching between a connected state and a disconnected state such that said second wheel of said chronograph train is connected to said mobile element of said going train element when said switching means is in a connected state, whereby said display means connected to said second wheel displays the unit of current time equivalent to the measured time, said unit of current time and said unit of measured time being a minute; and a locking device arranged for locking the control device while the switching means are connecting the second wheel of the second train element to said mobile element, said mobile element being connected to a current time minute hand and the second wheel being connected to a measured time minute hand, such that, while the locking device is locking the control device, the switching means positions the second wheel with reference to the first mobile such that the two hands are superposed.

16. A chronograph watch movement, including a frame, the chronograph watch movement comprising:

an energy source;

a time base powered by the energy source;

a current time measuring hand;

a first drive train rotating in synchronization with said time base, said first drive train element including a first gear connected to said current measuring time hand;

a chronograph mechanism including:

a first display means;

a second display means;

a second chronograph drive train actuated in synchronism with said time base, said second chronograph drive train including a first chronograph gear and a second chronograph gear, said first chronograph gear completing one revolution in sixty seconds, said second chronograph gear completing one revolution in sixty minutes, said first chronograph gear and said second chronograph gear being arranged coaxially with said first gear of said first drive train, said first chronograph gear being connected to said first display means, said second chronograph gear being connected to said second display means;

a control means for controlling said first chronograph gear and said second chronograph gear;

a resetting means for resetting said first display means and said second display means; and a switching means for switching between a connected state and a disconnected state such that said second chronograph gear of said chronograph drive train is connected to said first gear of said first drive train when said switching means is in said connected state, said second display means being superimposed with said current measuring time hand when said second chronograph gear is connected to said first gear;

an isolation device comprising:

an isolation gear including a first plate of the same diameter as the first gear, and a second plate arranged for cooperating with a pawl and provided with a pin for activating the hammer;

a retaining member comprising a lever and a retaining wheel mounted for rotation on the lever, said retaining member including first and second plates arranged such that said first and second plates mesh respectively with the first plate of the isolation gear and the minute gear of the first train drive, and connected to each other by a one-directional coupling mechanism, and isolation control members comprising:

an isolation lever, a pawl pivotably mounted on the lever and cooperating with the second plate of the isolation gear to move said pawl with respect to the first plate and said pin, said pin raising the hammer to interrupt the connection between the second wheel of the second drive train and the minute gear of the first drive train.

* * * * *